US005910242A

United States Patent [19]

Halbert et al.

[11] Patent Number: 5,910,242

[45] Date of Patent: Jun. 8, 1999

[54] PROCESS FOR REDUCTION OF TOTAL ACID NUMBER IN CRUDE OIL

[75] Inventors: Thomas R. Halbert; Kenneth L. Riley; Kenneth L. Trachte, all of Baton Rouge, La.; David L. Vannauker, Kingwood, Tex.

[73] Assignee: Exxon Research and Engineering Company, Florham Park, N.J.

[21] Appl. No.: 08/920,701

[22] Filed: Aug. 29, 1997

[51] Int. Cl.[6] ..... C10G 17/00

[52] U.S. Cl. ..... 208/263; 208/208 R

[58] Field of Search ..... 208/263, 208 R

[56] References Cited

U.S. PATENT DOCUMENTS

| | | | |
|---|---|---|---|
| 2,921,023 | 1/1960 | Holm et al. | 208/263 |
| 3,488,716 | 1/1970 | Eng | 208/263 |
| 3,617,501 | 11/1971 | Eng et al. | 208/60 |
| 3,850,744 | 11/1974 | Plundo et al. | 208/263 |
| 3,876,532 | 4/1975 | Plundo et al. | 208/216 |
| 5,397,459 | 3/1995 | Butler | 208/179 |

*Primary Examiner*—Helane Myers
*Attorney, Agent, or Firm*—James H. Takemoto

[57] ABSTRACT

A process for reducing the total acid number of an acidic crude by treating the crude with hydrogen treat gas in the presence of a hydrotreating catalyst wherein the treat gas also contains hydrogen sulfide.

9 Claims, 2 Drawing Sheets

PROCESS FOR REDUCTION OF TOTAL ACID NUMBER IN CRUDE OIL

FIELD OF THE INVENTION

This invention relates to a process for catalytically reducing the total acid number of acidic crude oils.

BACKGROUND OF THE INVENTION

Because of market constraints, it is becoming economically more attractive to process highly acidic crudes such as acidic naphthenic crudes. It is well known that processing such acidic crudes can lead to various problems associated with naphthenic and other acid corrosion. A number of methods to reduce the Total Acid Number (TAN), which is the number of milligrams of potassium hydroxide required to neutralize the acid content of one gram of crude oil, have been proposed.

One approach is to chemically neutralize acidic components with various bases. This method suffers from processing problems such as emulsion formation, increase in concentration of inorganic salts and additional processing steps. Another approach is to use corrosion-resistant metals in processing units. This, however, involves significant expense and may not be economically feasible for existing units. A further approach is to add corrosion inhibitors to the crudes. This suffers from the effects of the corrosion inhibitors on downstream units, for example, lowering of catalyst life/efficiency. Furthermore, confirmation of uniform and complete corrosion protection is difficult to obtain even with extensive monitoring and inspection. Another option is to lower crude acid content by blending the acidic crude with crudes having a low acid content. The limited supplies of such low acid crudes makes this approach increasingly difficult.

U.S. Pat. No. 3,617,501 discloses an integrated process for refining whole crude. The first step is a catalytic hydrotreatment of the whole crude to remove sulfur, nitrogen, metals and other contaminants. U.S. Pat. No. 2,921,023 is directed toward a method of improving catalyst activity maintenance during mild hydrotreating to remove naphthenic acids in high boiling petroleum fractions. The catalyst is molybdenum on a silica/alumina support wherein the feeds are heavy petroleum fractions. U.S. Pat. No. 2,734,019 describes a process for treating a naphthenic lubricating oil fraction by contacting with a cobalt molybdate on a silica-free alumina catalyst in the presence of hydrogen to reduce the concentration of sulfur, nitrogen and naphthenic acids. U.S. Pat. No. 3,876,532 relates to a very mild hydrotreatment of virgin middle distillates in order to reduce the total acid number or the mercaptan content of the distillate without greatly reducing the total sulfur content using a catalyst which has been previously deactivated in a more severe hydrotreating process.

It would be desirable to reduce the acidity of crude oils without the addition of neutralization/corrosion protection agents and without converting the crude into product streams.

SUMMARY OF THE INVENTION

This invention relates to a process for reducing the total acid number of an acidic crude oil which comprises contacting the crude oil with a hydrotreating catalyst at a temperature of from about 200 to 370° C. in the presence of a hydrogen treat gas containing hydrogen sulfide at a total pressure of from about 239 to 13,900 kPa wherein the mole percent of hydrogen sulfide in the treat gas is from 0.05 to 25.

DETAILED DESCRIPTION OF THE INVENTION

Figure 1:
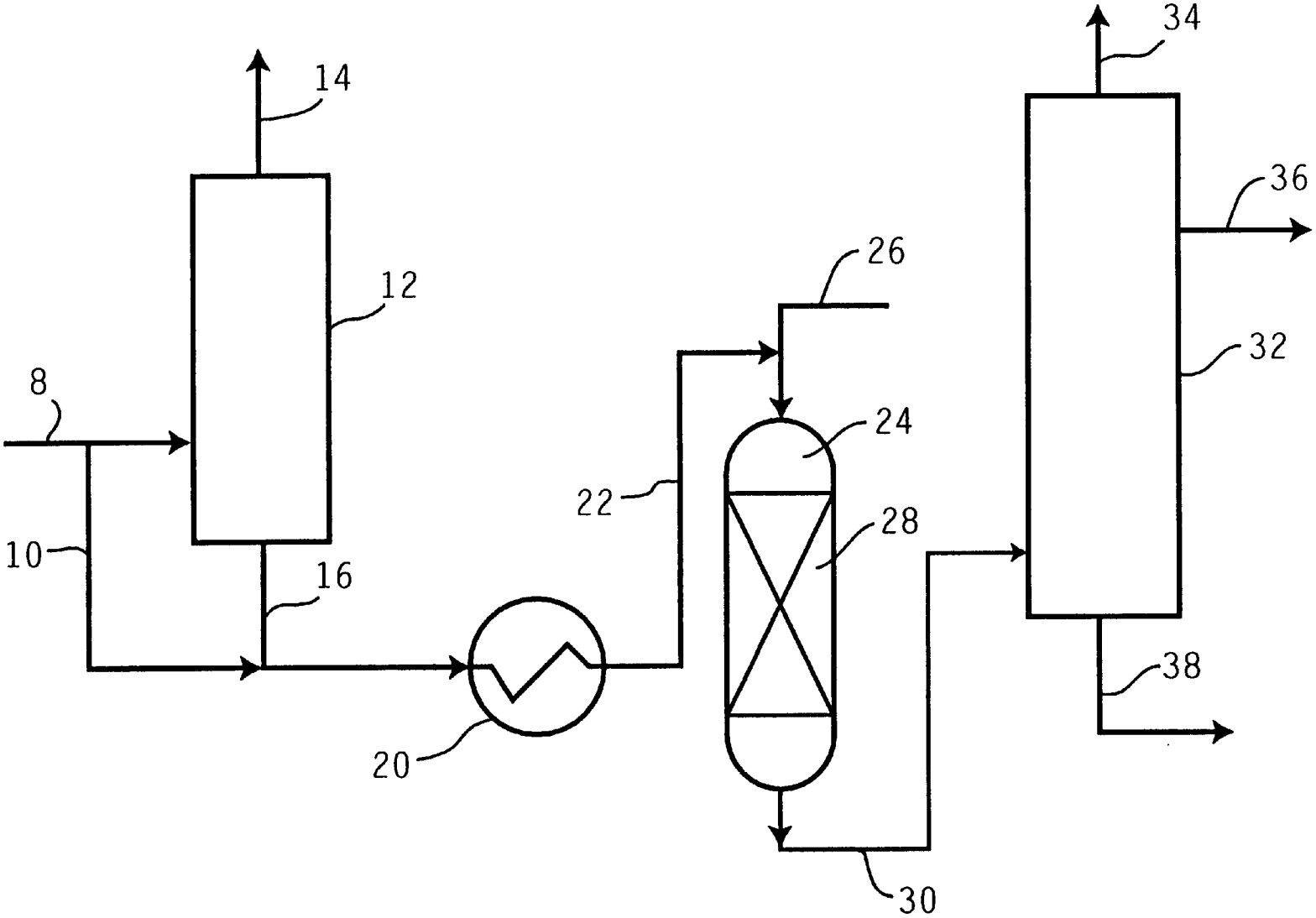
FIG. 1 is a schematic flow diagram of the process for reducing the acidity of crude oils.

Acidic crudes typically contain naphthenic and other acids and have TAN numbers of 1 up to 8. It has been discovered that the TAN value of an acidic crude can be substantially reduced by hydrotreating the crude or topped crude in the presence of hydrogen gas containing hydrogen sulfide. Hydrotreating catalysts are normally used to saturate olefins and/or aromatics, and reduce nitrogen and/or sulfur content of refinery feed/product streams. Such catalysts, however, can also reduce the acidity of crudes by reducing the concentration of naphthenic acids.

Hydrotreating catalysts are those containing Group VIB metals (based on the Periodic Table published by Fisher Scientific) and non-noble Group VIII metals. These metals or mixtures of metals are typically present as oxides or sulfides on refractory metal supports. Examples of such catalysts are cobalt and molybdenum oxides on a support such as alumina. Other examples include cobalt/nickel/molybdenum oxides or nickel/molybdenum oxides on a support such as alumina. Such catalysts are typically activated by sulfiding prior to use. Preferred catalysts include cobalt/molybdenum (1–5% Co as oxide, 5–25% Mo as oxide), nickel/molybdenum (1–5% Ni as oxide, 5–25% Mo as oxide) and nickel/tungsten (1–5% Ni as oxide, 5–30% W as oxide) on alumina. Especially preferred are nickel/molybdenum and cobalt/molybdenum catalysts.

Suitable refractory metal supports are metal oxides such as silica, alumina, titania or mixtures thereof. Low acidity metal oxide supports are preferred in order to minimize hydrocracking and/or hydroisomerization reactions. Particularly preferred supports are porous aluminas such as gamma or beta aluminas having average pore sizes of from 50 to 300 Å, a surface area of from 100 to 400 $m^2/g$ and a pore volume of from 0.25 to 1.5 $cm^3/g$.

Reaction conditions for contacting acidic crude with hydrotreating catalysts include temperatures of from about 200 to 370° C., preferably about 232 to 316° C. most preferably about 246 to 288° C. and a LHSV of from 0.1 to 10, preferably 0.3 to 4. The amount of hydrogen may range from a hydrogen partial pressure of about 20 to 2000 psig (239 to 13,900 kPa), preferably from 50 to 500 psig (446 to 3550 kPa). The hydrogen:crude feed ratio is from 20 to 5000 scf/B, preferably from 30 to 1500 scf/B, most preferably 50 to 500 scf/B.

It has been discovered that adding hydrogen sulfide to the hydrogen treat gas substantially improves the reduction of TAN for an acidic crude. It appears that the introduction of hydrogen sulfide into the treat gas improves the activity of the hydrotreating catalyst. The amount of hydrogen sulfide in the hydrogen treat gas may range from a hydrogen sulfide mole % of from 0.05 to 25, preferably 1 to 15, most preferably 2 to 10. Hydrogen sulfide may be added to the hydrogen treat gas. In the alternative, a sour hydrogen containing refinery gas stream such as the off-gas from a high pressure hydrotreater may be used as the hydrotreating gas.

In a typical refining process, crude oil is first subjected to desalting. The crude oil may then be heated and the heated crude oil conducted to a pre-flash tower to remove most of the products having boiling points of less than about 100° C. prior to distillation in an atmospheric tower. This reduces the load on the atmospheric tower. Thus crude oil as used herein includes whole crudes and topped crudes.

The present process for reducing the acidity of highly acidic crudes utilizes a heat exchanger and/or furnace, and a catalytic treatment zone prior to the atmospheric tower. The heat exchanger and/or furnace preheats the crude oil. The heated crude is then conducted to a catalytic treatment zone which includes a reactor and catalyst. The reactor is preferably a conventional trickle bed reactor wherein crude oil is conducted downwardly through a fixed bed of catalyst, but other reactor designs including but not limited to ebullated beds and slurries can be used.

The process of the invention is further illustrated by FIG. 1. Crude oil which may be preheated is conducted through line 8 to pre-flash tower 12. Overheads containing gases and liquids such as light naphthas are removed from the pre-flash tower through line 14. The remaining crude oil is conducted through line 16 to heater 20. Alternatively, crude oil may be conducted directly to heater 20 via line 10. The heated crude oil from heater 20 is then conducted to reactor 24 via line 22. The order of heater 20 and reactor 24 may be reversed provided that the crude oil entering reactor 24 is of sufficient temperature to meet the temperature requirements of reactor 24. In reactor 24, crude oil is contacted with a bed of hot catalyst 28 in the presence of hydrogen treat gas containing hydrogen sulfide added through line 26. Crude oil flows downwardly through the catalyst bed 28 and is conducted through line 30 to atmospheric tower 32. Atmospheric tower 30 operates in a conventional manner to produce overheads which are removed through line 34, various distillation fractions such as heavy virgin naphtha, middle distillates, heavy gas oil and process gas oil which are shown as collectively removed through line 36. Reduced crude is removed through line 3 8 for further processing in a vacuum distillation tower (not shown).

In reactor 24, the TAN of the crude oil is catalytically reduced by converting lower molecular weight naphthenic acid components in the crude oil to produce CO, $CO_2$, $H_2O$ and non-acidic hydrocarbon products. The reactor conditions in reactor 24 are such that there is very little if any aromatic ring saturation occurring even in the presence of added hydrogen. These mild reactor conditions are also insufficient to promote hydrocracking or hydroisomerization reactions. In the presence of hydrogen, there may be some conversion of reactive sulfur, i.e., non-thiophene sulfur to $H_2S$.

The invention is further illustrated by the following non-limiting examples.

EXAMPLE 1

This example is directed to the reduction of naphthenic acids present in a high acid crude. A pilot unit was loaded with hydrotreating catalyst, and the catalyst sulfided in a conventional manner using a virgin distillate carrier containing dimethyl disulfide as a sulfur source. Two different commercially available Ni/Mo hydrotreating catalysts were studied. Catalyst A is a conventional high metals content Ni/Mo catalyst typically used in pretreating fluid cat cracker feeds, while catalyst B is a low metals content wide pore catalyst typically used for hydrodemetallation. A high acid crude having a TAN value of 3.7 (mg KOH/ml) was used as feed oil. The crude oil was treated under the conditions summarized in Table 1.

TABLE 1

| Expt. No. | Treat Gas | Temp. °C. | $H_2$ Press kPa | LHSV | Treat Ratio SCF/B |
|---|---|---|---|---|---|
| 1 | $H_2$ | 260 | 2170 | 1 | 100 |
| 2 | $H_2$ containing 4 mol % $H_2S$ | 260 | 2170 | 1 | 100 |

Figure 2:
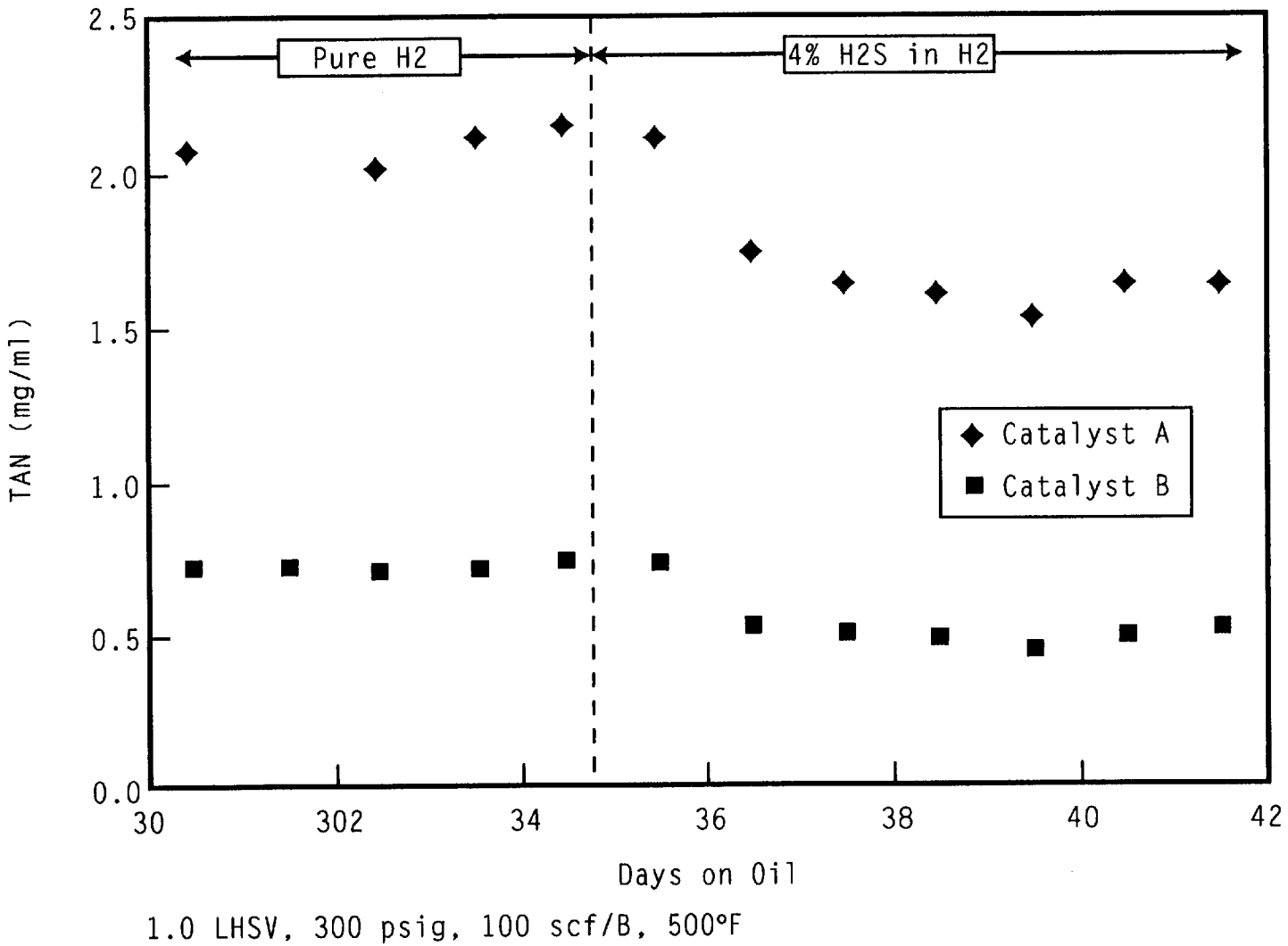
FIG. 2 is a graph showing the effect of added hydrogen sulfide on TAN reduction.

FIG. 2 is a graph of the measured TAN of the products under the experimental conditions of Table 1. Clearly, the TAN of the products is lower in the presence of $H_2S$.

Table 2 gives first order kinetic rate constants calculated for reduction of TAN and referenced to the activity of Catalyst A in the absence of $H_2S$.

TABLE 2

| Catalyst | Expt. 1 (No $H_2S$) | Expt. 2 (4% $H_2S$) |
|---|---|---|
| A | 100 | 130 |
| B | 30 | 45 |

Although the lower metals content catalyst B is markedly less active than catalyst A for TAN removal, the activity of both catalysts is increased by 30–50% when 4 vol. % $H_2S$ is included in the treat gas.

This is the opposite result when compared to conventional hydrodesulfurinzation (HDS) and hydrodenitrification (HDN) reactions in hydrotreating where it has been observed that hydrogen sulfide inhibits both HDS and HDN reactions. Thus the effect of adding hydrogen sulfide to the hydrogen treat gas is unexpected

EXAMPLE 2

The procedure of Example 1 was followed except new catalysts are employed. Catalyst C is a high metals content Co/Mo catalyst of the type used in distillate desulfurization. Catalyst D is a high metals content Co/Mo catalyst used in resid hydrotreating. Tables 3 and 4 are analogous to Tables 1 and 2 in Example 1.

TABLE 3

| Expt. No. | Treat Gas | Temp. °C. | $H_2$ Press kPa | LHSV | Treat Ratio SCF/B |
|---|---|---|---|---|---|
| 3 | $H_2$ | 260 | 2170 | 1 | 500 |
| 4 | $H_2$ containing 4 mol % $H_2S$ | 260 | 2170 | 1 | 500 |

TABLE 4

| Catalyst | Expt. 3 (No $H_2S$) | Expt. 4 (4% $H_2S$) |
|---|---|---|
| C | 100 | 146 |
| D | 83 | 160 |

Similar to the results shown in Table 2, the activity of both catalysts is increased by 50 to 95% when 4 mol. % of $H_2S$ is included in the treat gas.

What is claimed is:

1. A process for reducing the total acid number of an acidic crude oil which comprises contacting the crude oil with a hydrotreating catalyst at a temperature of from about 200 to 370° C. in the presence of a hydrogen treat gas containing hydrogen sulfide at a total pressure of from about 239 to 13,900 kPa wherein the mol. % hydrogen sulfide in the treat gas is from 0.05 to 25.

2. The process of claim 1 wherein the catalyst is cobalt/molybdenum oxide, nickel/molybdenum oxide or nickel/tungsten oxide on a refractory metal support.

3. The process of claim 2 wherein the refractory support comprises silica, alumina, titania or mixtures thereof.

4. The process of claim 1 wherein the temperature is from 232 to 316° C.

5. The process of claim 1 wherein the hydrogen partial pressure is from 446 to 3550 kPa.

6. The process of claim 1 wherein the LHSV is from 0.1 to 10.

7. The process of claim 1 wherein the hydrogen:crude feed ratio is from 30 to 1500 scf/B.

8. The process of claim 1 wherein the amount of $H_2S$ in the treat gas is from 1 to 15 mol. %.

9. The process of claim 1 wherein the catalyst is Co/Mo oxide on an alumina support.

* * * * *